US011783957B2

(12) United States Patent
Uno et al.

(10) Patent No.: US 11,783,957 B2
(45) Date of Patent: Oct. 10, 2023

(54) LIQUID TARGET DEVICE

(71) Applicant: SUMITOMO HEAVY INDUSTRIES, LTD., Tokyo (JP)

(72) Inventors: Hiroyuki Uno, Ehime (JP); Shigeharu Ochi, Ehime (JP); Francisco Guerra Gomez, Ehime (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 749 days.

(21) Appl. No.: 16/824,342

(22) Filed: Mar. 19, 2020

(65) Prior Publication Data

US 2020/0305268 A1 Sep. 24, 2020

(30) Foreign Application Priority Data

Mar. 22, 2019 (JP) ..... 2019-054739

(51) Int. Cl.
*G21K 5/08* (2006.01)
*G21G 1/10* (2006.01)

(52) U.S. Cl.
CPC ..... *G21K 5/08* (2013.01); *G21G 1/10* (2013.01)

(58) Field of Classification Search
CPC ..... G21G 1/10; G21K 5/08
See application file for complete search history.

(56) References Cited

U.S. PATENT DOCUMENTS 6,586,747 B1 * 7/2003 Erdman ..... H05H 6/00 376/195
2006/0062342 A1 3/2006 Gonzalez Lepera et al.
2010/0086095 A1 4/2010 Ogasawara et al.

FOREIGN PATENT DOCUMENTS

JP 4541445 B2 9/2010
JP 5442523 B2 3/2014
WO 2008/149600 A1 12/2008
WO 2011/064388 A1 6/2011

OTHER PUBLICATIONS

Search Report issued in European Application No. 20164141.2-1211, dated Aug. 28, 2020.

* cited by examiner

*Primary Examiner* — Sharon M Davis
(74) *Attorney, Agent, or Firm* — Michael Best & Friedrich LLP

(57) ABSTRACT

A liquid target device includes a liquid accommodation portion in which a target liquid is accommodated, a beam passage through which a charged particle beam emitted from a particle accelerator passes to reach the liquid accommodation portion, a target foil that separates the beam passage and the liquid accommodation portion from each other, and a vacuum foil that separates a vacuum region provided upstream of the beam passage and the beam passage from each other. The beam passage is provided with a first gas chamber into which a cooling gas is supplied at a position on the vacuum foil side and a second gas chamber into which a cooling gas is supplied at a position closer to the target foil side than the first gas chamber and the first gas chamber and the second gas chamber are separated from each other by an intermediate foil.

9 Claims, 2 Drawing Sheets

LIQUID TARGET DEVICE

RELATED APPLICATIONS

The content of Japanese Patent Application No. 2019-054739, on the basis of which priority benefits are claimed in an accompanying application data sheet, is in its entirety incorporated herein by reference.

BACKGROUND

Technical Field

A certain embodiment of the present invention relates to a liquid target device.

Description of Related Art

As a technique in the related art, a liquid target device as described in the related art has been known. A target liquid is accommodated in the liquid target device and the target liquid is irradiated with a charged particle beam accelerated by a particle accelerator such that a radioisotope (RI) of the target liquid is generated.

SUMMARY

According to an aspect of the present invention, there is provided a liquid target device including a liquid accommodation portion in which a target liquid is accommodated, a beam passage through which a charged particle beam emitted from a particle accelerator passes to reach the liquid accommodation portion, a target foil that separates the beam passage and the liquid accommodation portion from each other, and a vacuum foil that separates a vacuum region provided upstream of the beam passage and the beam passage from each other. The beam passage is provided with a first gas chamber into which a cooling gas is supplied at a position on the vacuum foil side and a second gas chamber into which a cooling gas is supplied at a position closer to the target foil side than the first gas chamber and the first gas chamber and the second gas chamber are separated from each other by an intermediate foil.

DETAILED DESCRIPTION

Figure 1:
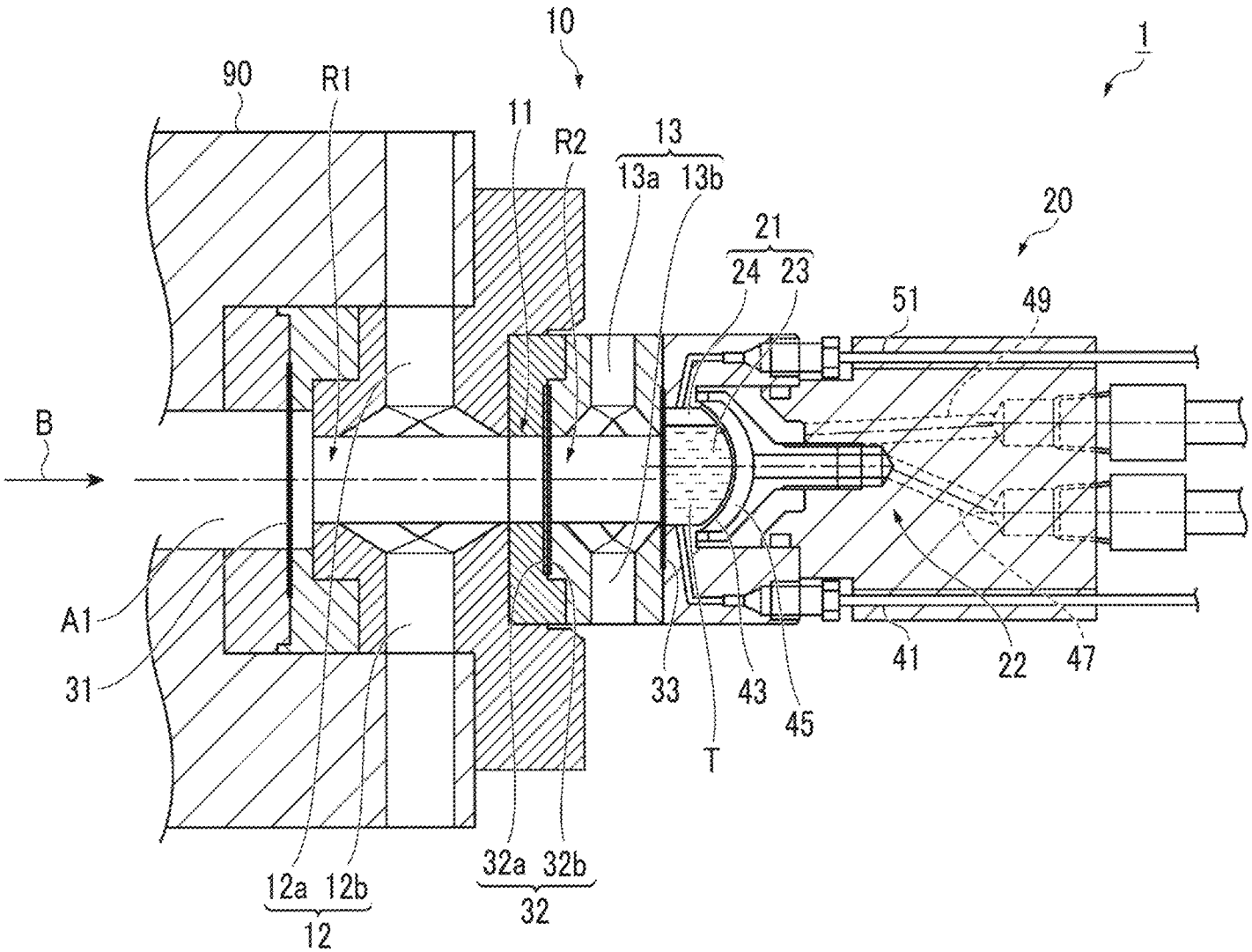
FIG. 1 is a sectional view of a liquid target device according to an embodiment.

Ina liquid target device, a so-called target foil covers an opening upstream of an accommodation portion of a target. In the case of such a device configuration, a target foil may be damaged during irradiation with a charged particle beam. When the target foil is damaged, the target liquid may flow into a particle accelerator side.

It is desirable to provide a liquid target device in which a target liquid is prevented from flowing out toward a particle accelerator side even when a target foil is damaged.

According to the liquid target device, a vacuum foil and an intermediate foil that partition a beam passage are provided between the target foil of a liquid accommodation portion and a vacuum region. Therefore, even in a case where the target foil is damaged and a target liquid held in a liquid accommodation portion flows out toward a second gas chamber, the movement thereof is restricted by the intermediate foil and thus the target liquid is prevented from moving to the vacuum region via a first gas chamber. Therefore, even when the target foil is damaged, the target liquid can be prevented from flowing out toward the particle accelerator side.

Here, a flow system for the cooling gas relating to the first gas chamber and a flow system for the cooling gas relating to the second gas chamber may be independent of each other.

According to such a configuration, even when the target liquid flows out to the second gas chamber and the target liquid is discharged to the outside of a system along with movement of the cooling gas, the target liquid can be prevented from being erroneously supplied to the first gas chamber or the like since the flow system for the cooling gas relating to the second gas chamber and the flow system for the cooling gas relating to the first gas chamber are independent of each other.

The liquid target device may further include a pipe through which a fluid discharged from the second gas chamber flows and a recovery unit that is provided in the pipe and recovers a foreign substance contained in the fluid.

In a case where a configuration, in which the recovery unit that recovers the foreign substance contained in the fluid is provided in the pipe through which the fluid discharged from the second gas chamber flows, is adopted, even when the target liquid leaks into the second gas chamber and flows to the pipe along with movement of the cooling gas, the target liquid can be recovered in the recovery unit and thus the target liquid can be prevented from flowing out to a subsequent stage.

A flow system for the cooling gas relating to the first gas chamber may be shared with another liquid target device that is different from the liquid target device.

In a case where one particle accelerator is provided with a plurality of liquid target devices, a flow system for a cooling gas may be shared with another liquid target device. In such a case, when a foreign substance such as the target liquid which is different from a cooling gas intrudes into the shared flow system, the influence thereof may become wide-ranging. However, when a configuration in which the flow system for the cooling gas relating to the first gas chamber that is on a side distant from the liquid accommodation portion in which the target liquid is accommodated is shared with the other liquid target device is adopted, the other liquid target device can be prevented from being influenced even in a case where the target foil is damaged.

Hereinafter, an embodiment of the present invention will be described in detail with reference to attached drawings. Note that, the same reference numerals are assigned to the same constituent elements in description of the drawings and repetitive descriptions thereof will be omitted.

FIG. 1 is a schematic configuration view of a liquid target device used in a radioisotope manufacturing system. The radioisotope manufacturing system (hereinafter, "RI manufacturing system") including a liquid target device 1 is an apparatus that manufactures a radioisotope (hereinafter, "RI") by irradiating a target liquid T with a charged particle beam B. The RI manufactured by means of the system is used to manufacture a radiopharmaceutical (including radioisotope drug), which is a radioisotope-labeled compound, for example. The target liquid T is, for example, $^{18}O$ water, an acidic solution containing a metallic element such as $^{68}Zn$, $^{65}Ni$, and $^{nat}Y$, and the like. Examples of a radioisotope-labeled compound generated from the target liquid T as described above include $^{18}$F-FDG (fluorodeoxyglucose), $^{68}$Ga-PSMA, $^{64}$Cu-DOTA-trastuzumab, $^{89}$Zr-trastuzumab as compounds to be used in a PET inspection (positron emission tomography inspection) in a hospital or the like.

The RI manufacturing system includes a particle accelerator in addition to the liquid target device 1. The particle accelerator is an accelerator that emits the charged particle beam B. Examples of charged particles include protons and heavy particles (heavy ions). Note that, as the particle accelerator, for example, a cyclotron, a linear accelerator (linac), or the like is used. As the charged particle beam, for example, a proton beam, a deuteron beam, an α-beam, or the like is used. In the following description, words such as "upstream side" and "downstream side" will be used corresponding to the upper stream and the lower stream of the charged particle beam emitted from a particle accelerator 3.

The liquid target device 1 is mounted into a manifold 90 that is provided in a port for emission of the charged particle beam, the port being provided in the cyclotron. The cyclotron adjusts the trajectory of the charged particle beam in an acceleration space such that the charged particle beam is extracted from the port. The extracted charged particle beam is incident into the manifold 90 and reaches the liquid target device 1.

The liquid target device 1 is configured to include a cooling unit 10 and a target holding unit 20. Note that, although the cooling unit 10 and the target holding unit 20 will be described separately in the present embodiment, the way in which the units are classified can be appropriately changed.

The cooling unit 10 is provided in a state of protruding from the manifold 90 of the cyclotron. The cooling unit 10 includes a beam passage 11, through which the charged particle beam B passes, at a position corresponding to an irradiation axis of the charged particle beam B. The beam passage 11 is formed to have a circular section with the irradiation axis of the charged particle beam B as a center line and is formed to extend along the irradiation axis.

The cooling unit 10 includes two sets of foils on the beam passage 11. By a vacuum foil 31, a region in the beam passage 11 that is upstream of the vacuum foil 31 is kept vacuum. In other words, a region upstream of the vacuum foil 31 is a vacuum region A1. In addition, an intermediate foil 32 is provided downstream of the vacuum foil 31 in the beam passage 11. The vacuum foil 31 and the intermediate foil 32 are thin circular foils formed of metal such as titanium and chromium or an alloy thereof and the thickness thereof is approximately 10 μm to 100 μm. As a foil, for example, a Havar foil or the like containing iron, cobalt, nickel, chromium, molybdenum, manganese, tungsten, or the like can be used. However, the foil is not limited thereto. In addition, the intermediate foil 32 may be provided by stacking two foils as described above. FIG. 1 shows a state where two foils 32*a* and 32*b* are stacked to form the intermediate foil 32. In a case where the intermediate foil 32 is formed by stacking the two foils 32*a* and 32*b*, the mechanical strength of the intermediate foil 32 can be increased.

In addition, the cooling unit 10 includes two sets of cooling flow paths 12 and 13 through which a cooling gas such as helium is blown to the beam passage 11. The cooling flow path 12 is configured to include a pair of cooling flow paths 12*a* and 12*b*. In addition, the cooling flow path 13 is configured to include a pair of cooling flow paths 13*a* and 13*b*.

The cooling flow path 12 is provided between the vacuum foil 31 and the intermediate foil 32 on the beam passage 11. The cooling flow paths 12*a* and 12*b* are provided to face each other with the beam passage 11 interposed therebetween. In addition, each of the cooling flow paths 12*a* and 12*b* branches into a portion facing an upstream side and a portion facing a downstream side. A cooling gas is blown to the vacuum foil 31 on the upstream side through a portion of the cooling flow path 12*a* that faces the upstream side and the cooling gas is blown to the intermediate foil 32 through a portion of the cooling flow path 12*a* that faces the downstream side (refer to FIG. 2 also). The cooling flow path 12*b* is provided as a flow path through which a cooling gas blown from the cooling flow path 12*a* is discharged from the beam passage 11.

The cooling flow path 13 is provided downstream of the intermediate foil 32 on the beam passage 11. The cooling flow paths 13*a* and 13*b* are provided to face each other with the beam passage 11 interposed therebetween. In addition, each of the cooling flow paths 13*a* and 13*b* branches into a portion facing an upstream side and a portion facing a downstream side. A cooling gas is blown to the intermediate foil 32 on the upstream side through a portion of the cooling flow path 13*a* that faces the upstream side and the cooling gas is blown to a target accommodation portion 23 (liquid accommodation portion) through a portion of the cooling flow path 13*a* that faces the downstream side (refer to FIG. 2 also). The cooling flow path 13*b* is provided as a flow path through which a cooling gas blown from the cooling flow path 13*a* is discharged from the beam passage 11.

The target holding unit 20 has an approximately columnar shape and includes a target foil 33, a target container portion 21, and a cooling mechanism 22. The target holding unit 20 is connected to the cooling unit 10 at a position downstream of the cooling flow path 13.

The target container portion 21 is disposed on an upstream side of the target holding unit 20. The target foil 33 is interposed between the target container portion 21 and the cooling unit 10 on the upstream side. Note that, a configuration in which the target foil 33 is supported by being interposed between members constituting the target holding unit 20 may also be adopted and a configuration in which the target foil 33 is supported by being interposed between members constituting the cooling unit 10 as shown in FIG. 1 may also be adopted.

In the case of a configuration as shown in FIG. 1, a portion of a front surface of the target foil 33 is exposed with respect to the beam passage 11. The target foil 33 allows abeam to pass therethrough but blocks a fluid such as the target liquid T and a helium gas. The target foil 33 is a Havar foil or a thin circular foil formed of metal such as niobium or an alloy and the thickness thereof is approximately 10 μm to 50 μm.

The target container portion 21 includes the target accommodation portion 23 that is formed at a center portion as seen in front view and in which the target liquid T can be accommodated and a buffer portion 24 that is positioned above the target accommodation portion 23 and communicates with the target accommodation portion 23. The target accommodation portion 23 and the buffer portion 24 are configured as a closed space formed when a front surface side of the target container portion 21 is closed by the target foil 33. A portion of the closed space is the target accommodation portion 23 in which the target liquid T is stored and a portion of the closed space that is above the liquid surface of the target liquid T is the buffer portion 24. In other words, the target foil 33 separates the beam passage 11 from the target accommodation portion 23 and the buffer portion 24. The target liquid T is supplied to the target accommodation portion 23 through a pipe 41 such that the target accommodation portion 23 is filled with the target liquid T and the target liquid T after processing is recovered through the pipe 41 again.

The cooling mechanism 22 is provided rearward of a rear wall 43 constituting the target accommodation portion 23 and the buffer portion 24. The cooling mechanism 22 cools the target accommodation portion 23 and the buffer portion 24 by supplying a cooling water that comes into contact with the rear wall 43. The cooling mechanism 22 includes a rear water path 45 that is immediately rearward of the rear wall 43, a water introduction path 47 through which the cooling water is introduced into the rear water path 45, and a water discharge path 49 through which the cooling water is discharged from the rear water path 45. The cooling water is supplied from the outside through a cooling water supply pipe connected to the water introduction path 47. By the cooling mechanism 22 as described above, the target liquid T in the target accommodation portion 23 is cooled. In addition, when the buffer portion 24 is cooled by the cooling mechanism 22, vapor evaporated from the target liquid T in the target accommodation portion 23 is condensed in the buffer portion 24 and returns to the target accommodation portion 23 due to the own weight thereof. Note that, the pressure in the target accommodation portion 23 and the buffer portion 24 is increased by an inert gas (for example, He) supplied through a pipe 51 and thus the boiling point of the target liquid T increases.

As described above, in the liquid target device 1, the vacuum foil 31, the intermediate foil 32, and the target foil 33 form two gas chambers on the beam passage 11 through which a cooling gas passes. That is, a first gas chamber R1 into which a cooling gas is supplied from the cooling flow path 12 (12*a* and 12*b*) and a second gas chamber R2 into which a cooling gas is supplied from the cooling flow path 13 (13*a* and 13*b*) are formed on the beam passage 11. The first gas chamber R1 and the second gas chamber R2 are separated from each other by the intermediate foil 32.

Next, the flow of cooling gases supplied to the first gas chamber R1 and the second gas chamber R2 will be described with reference to FIG. 2. In the liquid target device 1, a flow system for the cooling gas supplied to the first gas chamber R1 and a flow system for the cooling gas supplied to the second gas chamber R2 can be made independent of each other. Note that, a flow system for a cooling gas refers to a pipe system relating to supply of the cooling gas to a gas chamber and discharge of the cooling gas from the gas chamber.

Figure 2:
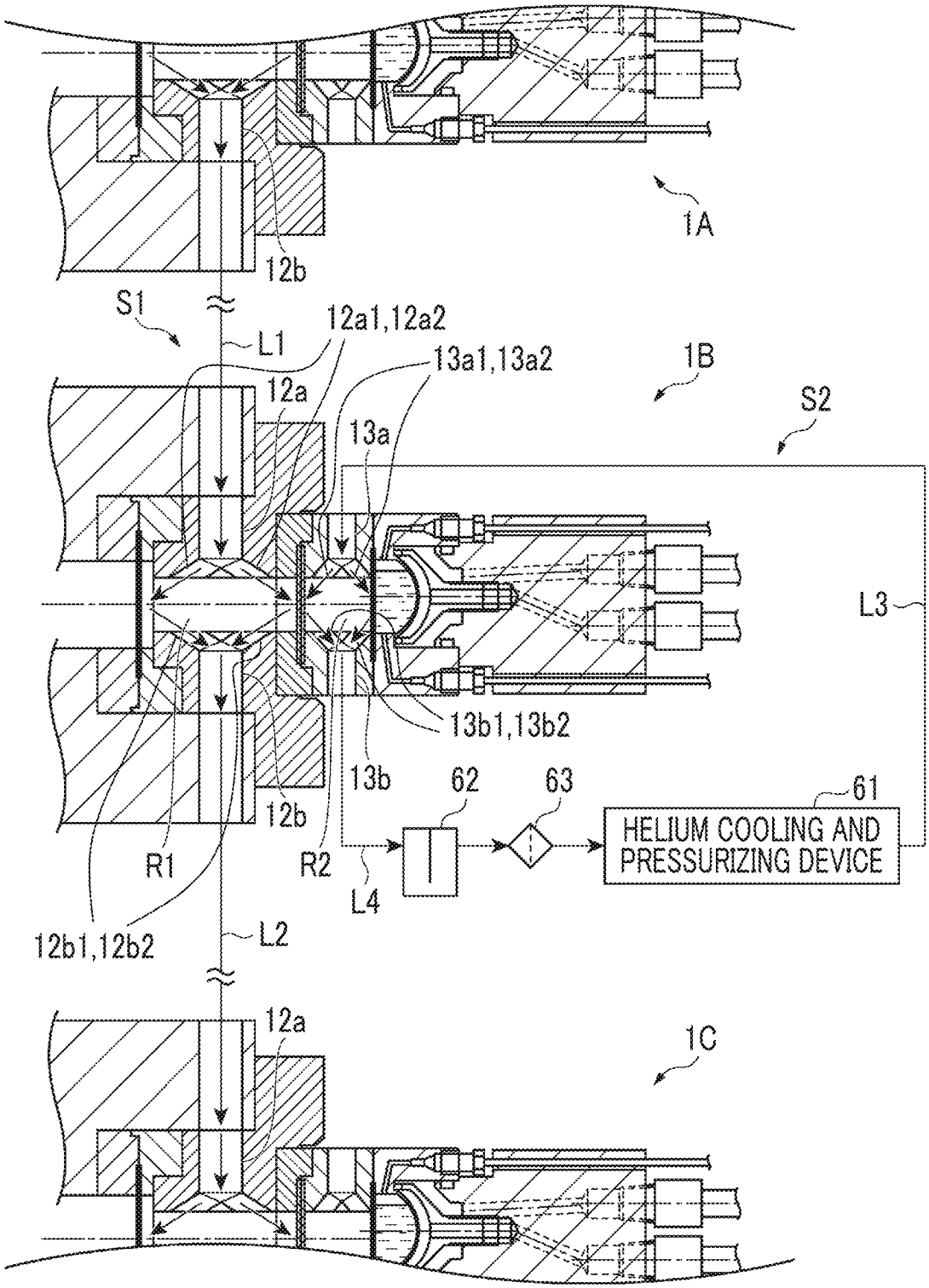
FIG. 2 is a view for describing a cooling gas supply system of the liquid target device.

In FIG. 2, three liquid target devices 1 (1A, 1B, and 1C) are shown. Although one liquid target device 1 has been described in FIG. 1, a plurality of the liquid target devices 1 may be attached to one particle accelerator in an actual case. For example, in a case where a particle accelerator is a cyclotron, the cyclotron is provided with a plurality of ports and the liquid target device 1 may be attached to each port via a manifold. In this case, the plurality of liquid target devices 1 are installed in a state of being somewhat close to each other. FIG. 2 schematically shows a state in which the three liquid target devices 1 (1A, 1B, and 1C) are disposed in parallel. However, in an actual case, adjacent liquid target devices 1 may be different from each other in installation angle depending on the configuration of the particle accelerator or the like.

In this case, a cooling gas supplied to the first gas chamber R1 on the upstream side can be shared between the adjacent liquid target devices 1. That is, a flow system S1 for the cooling gas supplied to the first gas chamber R1 is shared with another liquid target device. In the case of an example shown in FIG. 2, a cooling gas supplied to the liquid target device 1A is supplied to the beam passage 11 (first gas chamber R1) of the liquid target device 1B from the cooling flow path 12*a* of the liquid target device 1B via a pipe L1 after being discharged from the cooling flow path 12*b*. Then, the cooling gas supplied to the first gas chamber R1 of the liquid target device 1B is supplied to the liquid target device 1C from the cooling flow path 12*a* of the liquid target device 1C via a pipe L2 after being discharged from the cooling flow path 12*b*. As described above, regarding a flow system for a cooling gas with respect to the first gas chamber R1, a configuration in which cooling flow paths provided with respect to the first gas chambers R1 of the liquid target devices 1 adjacent to each other from among the plurality of liquid target devices 1 are connected to each other via a pipe and a cooling gas is supplied via the pipe can also be adopted.

Meanwhile, a flow system S2 for a cooling gas to the second gas chamber R2 can be provided to be independent of an adjacent liquid target device 1. FIG. 2 shows the flow system S2 for a cooling gas supplied to the liquid target device 1B. In the case of such a supply system, a cooling gas (helium gas) cooled in a helium cooling and pressurizing device 61 is sent to the cooling flow path 13*a* via a pipe L3 and is supplied to the second gas chamber R2 from the cooling flow path 13*a*. As described above, a flow system for a cooling gas relating to the first gas chamber R1 and a flow system for a cooling gas relating to the second gas chamber R2 can be made independent of each other.

Note that, a cooling gas discharged from the second gas chamber R2 via the cooling flow path 13*b* is returned to the helium cooling and pressurizing device 61 via a pipe L4. Note that, on the pipe L4, a gas-water separation device 62 and a filter 63 are provided. The gas-water separation device 62 and the filter 63 function as a recovery unit that recovers a foreign substance including the target liquid T in a case where the target foil 33 is damaged and the target liquid T flows into the pipe L4. Here, the "foreign substance" refers to all substances different from a cooling gas which is a fluid supposed to flow through the flow systems S1 and S2. The only fluid supposed to flow through the pipe L4 is a helium gas.

The gas-water separation device 62 is provided to prevent the target liquid T from flowing to the subsequent stage in a case where a fluid (helium gas) flowing through the pipe L4 contains the target liquid T with the target foil 33 being damaged. Although the configuration of a device for gas-water separation is not particularly limited, a configuration in which gas-water separation can be performed by changing the shape of a tank as shown in FIG. 2 may be adopted. In addition, a function of performing a neutralization process with respect to a liquid or a gas recovered in the gas-water separation device 62 may be provided.

The filter 63 is provided to remove water vapor and the like contained in a gas flowing through the pipe L4. In addition, in a case where a gas of which a component is different from the helium gas is contained in the gas, a filter that can adsorb the component may be used.

A gas flowing from the second gas chamber R2 is returned to the helium cooling and pressurizing device 61 via the gas-water separation device 62 and the filter 63 on the pipe L4. Since the gas passes through the gas-water separation device 62 and the filter 63, the target liquid T flowing in can be removed even in a case where the target foil 33 is damaged. Therefore, the helium cooling and pressurizing device 61 can be prevented from being damaged.

As described above, in the liquid target device 1 according to the present embodiment, the vacuum foil 31 and the intermediate foil 32 that partition the beam passage 11 are provided between the target foil 33 defining the target accommodation portion 23 (liquid accommodation portion) and the vacuum region A1 on the upstream side. Therefore, even in a case where the target foil 33 is damaged and a target liquid held in the target accommodation portion 23 flows out toward the second gas chamber R2, the movement thereof is restricted by the intermediate foil 32. Therefore, the target liquid is prevented from moving to the vacuum region on the upstream side via the first gas chamber R1. Therefore, even when the target foil 33 is damaged, the target liquid can be prevented from flowing out toward the particle accelerator side.

In a configuration in the related art, no intermediate foil 32 is provided and a gas chamber through which a cooling gas passes is configured as one chamber. Therefore, in a case where the target foil 33 is damaged and the target liquid T leaks into the gas chamber, the target liquid T may flow to a position downstream of the vacuum foil 31. In this case, the target liquid T may flow to the vacuum region A1 on the upstream side when the vacuum foil 31 is damaged. When the target liquid T flows to the vacuum region A1, the particle accelerator on the upstream side may be influenced. Particularly, in a case where an acidic target liquid T is used, the vacuum region A1 may be corroded by an acid, which results in a serious influence. With regard to this, in the liquid target device 1 according to the present embodiment, the beam passage 11 is provided with the two gas chambers separated from each other by the intermediate foil 32 such that the leakage of the target liquid T is prevented from reaching the vacuum foil 31. Therefore, even when the target foil 33 is damaged, the target liquid T moving toward the particle accelerator can be suppressed.

In addition, the flow system S1 for a cooling gas relating to the first gas chamber R1 and the flow system S2 for a cooling gas relating to the second gas chamber R2 can be made independent of each other. According to such a configuration, even when the target liquid T flows out to the second gas chamber R2 and the target liquid T is discharged to the outside of a system via the flow system S2 along with movement of a cooling gas, the target liquid T can be prevented from being erroneously supplied to the first gas chamber R1 or the like since the flow system S2 for the cooling gas relating to the second gas chamber R2 and the flow system S1 for the cooling gas relating to the first gas chamber R1 are independent of each other. That is, only the second gas chamber R2 comes into contact with the target liquid T and the first gas chamber R1 can be prevented from coming into contact with the target liquid T and thus the target liquid T can be prevented from moving toward the particle accelerator.

In addition, the pipe L4 through which a fluid discharged from the second gas chamber R2 flows and the gas-water separation device 62 and the filter 63 as the recovery unit that is provided in the pipe L4 and recovers a foreign substance contained in the fluid may further be provided. According to such a configuration, even when the target liquid T leaks into the second gas chamber R2 and flows to the pipe L4 along with movement of the cooling gas, a foreign substance relating to the target liquid T can be recovered in the recovery unit and thus the target liquid T can be prevented from flowing out to a subsequent stage. That is, the foreign substance relating to the target liquid T can be prevented from being discharged out of the system and a pump, a pipe, and the like for supply of a cooling gas to the second gas chamber R2 like the helium cooling and pressurizing device 61 can be prevented from coming into contact with a substance relating to the target liquid T.

In addition, as described above, the flow system S1 for the cooling gas supplied to the first gas chamber R1 is shared with another liquid target device different from the liquid target device. In a case where one particle accelerator is provided with a plurality of liquid target devices, a flow system for a cooling gas may be shared with another liquid target device. In such a case, when a foreign substance such as the target liquid T which is different from a cooling gas intrudes into the shared flow system, the influence thereof may become wide-ranging. However, when a configuration in which the flow system for the cooling gas relating to the first gas chamber R1 that is on a side distant from the target accommodation portion 23 is shared with another liquid target device is adopted as in the case of the liquid target device 1 described above, the other liquid target device can be prevented from being influenced even in a case where the target foil 33 is damaged.

Starting with the above-described embodiment, the present invention can be carried out in various modes that are variously modified and improved on the basis of the knowledge of those skilled in the art. In addition, modification examples can also be configured using technical features described in the above-described embodiment. The configurations of each embodiment may be appropriately combined with each other.

For example, the shape or the like of each part constituting the liquid target device 1 can be appropriately changed. For example, although the second gas chamber R2 has been described as a portion of the cooling unit 10, a configuration relating to the second gas chamber R2 may be configured as a portion of the target holding unit 20.

In addition, a structure or the like supporting the foils is not limited to that described in the above-described embodiment. In addition, the intermediate foil 32 does not need to be formed by stacking two foils and may be configured by using one foil.

In addition, the number of gas chambers provided in the beam passage 11 may be three or more. However, since the number of members separating gas chambers from each other (members corresponding to intermediate foil 32) increases as the number of gas chambers increases, the efficiency of irradiation of the target liquid T with a charged particle beam may be lowered.

In addition, a configuration in which the flow system S1 for the cooling gas relating to the first gas chamber R1 and the flow system S2 for the cooling gas related to the second gas chamber R2 are not independent from each other may also be adopted. However, for example, when a configuration in which a cooling gas discharged from the second gas chamber R2 is prevented from being directly supplied to the first gas chamber R1 is adopted, a foreign substance relating to the target liquid T can be prevented from flowing to the first gas chamber R1 in a case where the target liquid T leaks into the second gas chamber R2 as described above. In addition, a configuration in which the flow system S1 for the cooling gas relating to the first gas chamber R1 is not shared with another liquid target device 1 may also be adopted.

In addition, the gas-water separation device 62 and the filter 63 as the recovery unit may be in a state of not exhibiting a function as the recovery unit when there is no abnormality in the liquid target device 1, that is, the target foil 33 is not damaged. In this case, when a configuration in which control is performed such that the function as the recovery unit is exhibited when some abnormality is detected is adopted, the function as the recovery unit described in the above-described embodiment can be realized.

It should be understood that the invention is not limited to the above-described embodiment, but may be modified into various forms on the basis of the spirit of the invention. Additionally, the modifications are included in the scope of the invention.

What is claimed is:

1. A liquid target device comprising:

a liquid accommodation portion in which a target liquid is accommodated;

a beam passage through which a charged particle beam emitted from a particle accelerator passes to reach the liquid accommodation portion;

a target foil positioned at a downstream end of the beam passage, the target foil separating the beam passage and the liquid accommodation portion from each other;

a vacuum foil positioned at an upstream end of the beam passage, the vacuum foil separating a vacuum region provided upstream of the beam passage and the beam passage from each other; and an intermediate foil positioned in the beam passage between the target foil and the vacuum foil, wherein the beam passage is divided by the intermediate foil into a first gas chamber comprising a first inlet into which a cooling gas is supplied at a position between the vacuum foil and the intermediate foil and a second gas chamber comprising a second inlet into which a cooling gas is supplied at a position between the intermediate foil and the target foil, wherein the first gas chamber and the second gas chamber are separated from each other by the intermediate foil, and wherein the liquid target device further comprises a pipe connected to the second gas chamber and configured to receive the cooling gas and the target liquid discharged from the second gas chamber, and a filter and a gas-liquid separation tank disposed in the pipe and configured to remove foreign substances and the target liquid from the cooling gas discharged from the second gas chamber and return the cooling gas to the second inlet.

2. The liquid target device according to claim 1, further comprising:

a first cooling flow path that is disposed between the first inlet and the first gas chamber; and a second cooling flow path that is disposed between the second inlet and the second gas chamber.

3. The liquid target device according to claim 2, wherein the first cooling flow path splits into a first branch directing the cooling gas to the vacuum foil and a second branch directing the cooling gas to the intermediate foil.

4. The liquid target device according to claim 3, further comprising:

a first outlet flow path connected to the first gas chamber and comprising a first branch that recovers the cooling gas provided to the vacuum foil from the first branch of the first cooling flow path and a second branch that recovers the cooling gas provided to the intermediate foil from the second branch of the first cooling flow path.

5. A flow system comprising at least two liquid target devices according to claim 4, wherein the cooling gas supplied to the liquid target device is supplied to a first gas chamber of another liquid target device from the first cooling flow path of the other liquid target device via a pipe after being discharged from the first outlet flow path of the liquid target device.

6. The liquid target device according to claim 2, wherein the second cooling flow path splits into a first branch directing the cooling gas to the intermediate foil and a second branch directing the cooling gas to the liquid accommodation portion.

7. The liquid target device according to claim 6, further comprising:

a second outlet flow path connected to the second gas chamber and comprising a first branch that recovers the cooling gas provided to the intermediate foil from the first branch of the second cooling flow path and a second branch that recovers the cooling gas provided to the liquid accommodation portion from the second branch of the second cooling flow path.

8. The liquid target device according to claim 1, wherein the intermediate foil is formed by stacking a plurality of foils.

9. The liquid target device according to claim 1, further comprising:

a first flow system configured to supply the cooling gas to the first inlet and a second flow system configured to supply the cooling gas to the second inlet, wherein the first flow system and the second flow system are independent of each other.

* * * * *